United States Patent [19]

Cornelius et al.

[11] 4,124,994

[45] Nov. 14, 1978

[54] BEVERAGE COOLING BATH

[75] Inventors: Richard T. Cornelius, Minnetonka; Charles G. Erickson, Anoka, both of Minn.

[73] Assignee: McQuay-Perfex Inc., Minneapolis, Minn.

[21] Appl. No.: 811,261

[22] Filed: Jun. 29, 1977

[51] Int. Cl.[2] ..... F25C 1/08

[52] U.S. Cl. ..... 62/138; 62/59; 62/435

[58] Field of Search ..... 62/59, 393, 138, 435

[56] References Cited

U.S. PATENT DOCUMENTS

| | | | |
|---|---|---|---|
| 3,020,726 | 2/1962 | MacLeod | 62/138 |
| 3,054,274 | 9/1962 | McGehee et al. | 62/138 |
| 4,036,621 | 7/1977 | Burton | 62/345 X |

*Primary Examiner*—William E. Wayner

*Attorney, Agent, or Firm*—Hill, Gross, Simpson, Van Santen, Steadman, Chiara & Simpson

[57] ABSTRACT

A beverage cooling bath includes a refrigeration evaporator immersed in water for growing ice thereon, there being a beverage cooling coil disposed elsewhere in such water. In order to turn the refrigeration system off when a sufficient amount of ice has built up on the evaporator, there is provided a control for doing so which includes a motor-driven impeller that directs a flow of water into a tube which divides, the one portion having an outlet through which such water normally flows along a freezing surface on the evaporator, and the other portion being a branch that leads to a sensing control which is responsive to an increase of water level or water pressure therein as a consequence of ice forming to block the other portion leading to the outlet.

18 Claims, 3 Drawing Figures

BEVERAGE COOLING BATH

BACKGROUND OF THE INVENTION

1. Field of the Invention:

This invention relates to a beverage cooling bath, and more specifically to means for controlling the size of an ice bank therein.

2. Prior Art:

It has been known heretofore to provide beverage cooling baths that include a water tank having water associated with a refrigeration evaporator, a beverage cooling coil being disposed therein. Various types of controls for sensing a predetermined quantity of ice on the evaporator have been proposed and provided, and these prior devices share complexity and cost.

SUMMARY OF THE INVENTION

The present invention is directed to a beverage cooling bath which has means for controlling the amount of ice that can be formed therein, including a tube having an inlet end which receives a flow of water from an impeller in the water and an outlet directed along the freezing surface of the evaporator, there being a branch having control means that communicate with such tube upstream of the point where ice would form.

Accordingly, it is an object of the present invention to provide an inexpensive beverage cooling bath assembly.

A further object of the present invention is to provide such an assembly that has a particularly simple and inexpensive means for controlling the amount of ice that can be formed therein.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

AS SHOWN ON THE DRAWINGS

Figure 1:
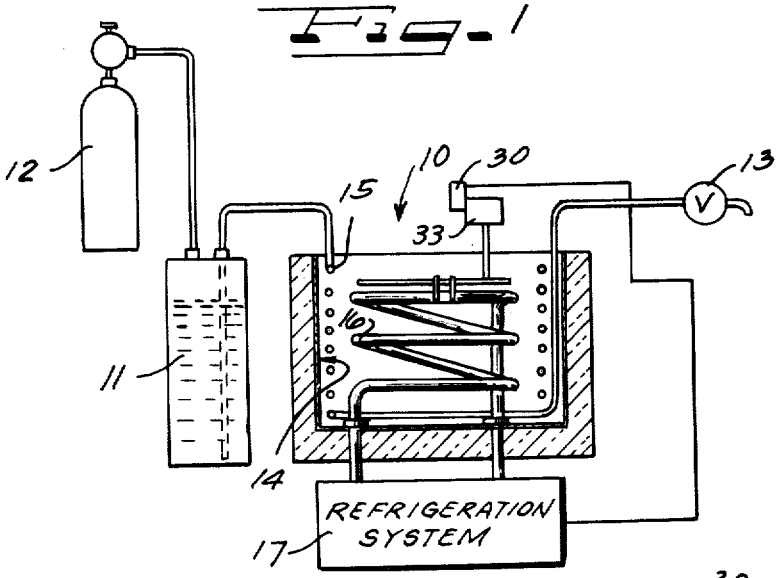
FIG. 1 is a diagram of a beverage dispensing system having a beverage cooling bath provided according to the present invention.

The principles of the present invention are particularly useful when embodied in a beverage dispensing system having a beverage cooling bath such as is schematically shown in FIG. 1, generally indicated by the numeral 10. The system includes a source of beverage 11 which is under pressure, for example from a source of carbon dioxide gas 12, and the beverage can be withdrawn from a dispensing valve 13, the beverage cooling bath 10 being connected between the source 11 and the valve 13. The bath 10 includes a water tank 14, a beverage cooling coil 15, and a separate evaporator coil 16. The evaporator 16 is adapted to be connected to and to form a part of a conventional refrigeration system 17.

Figure 2:
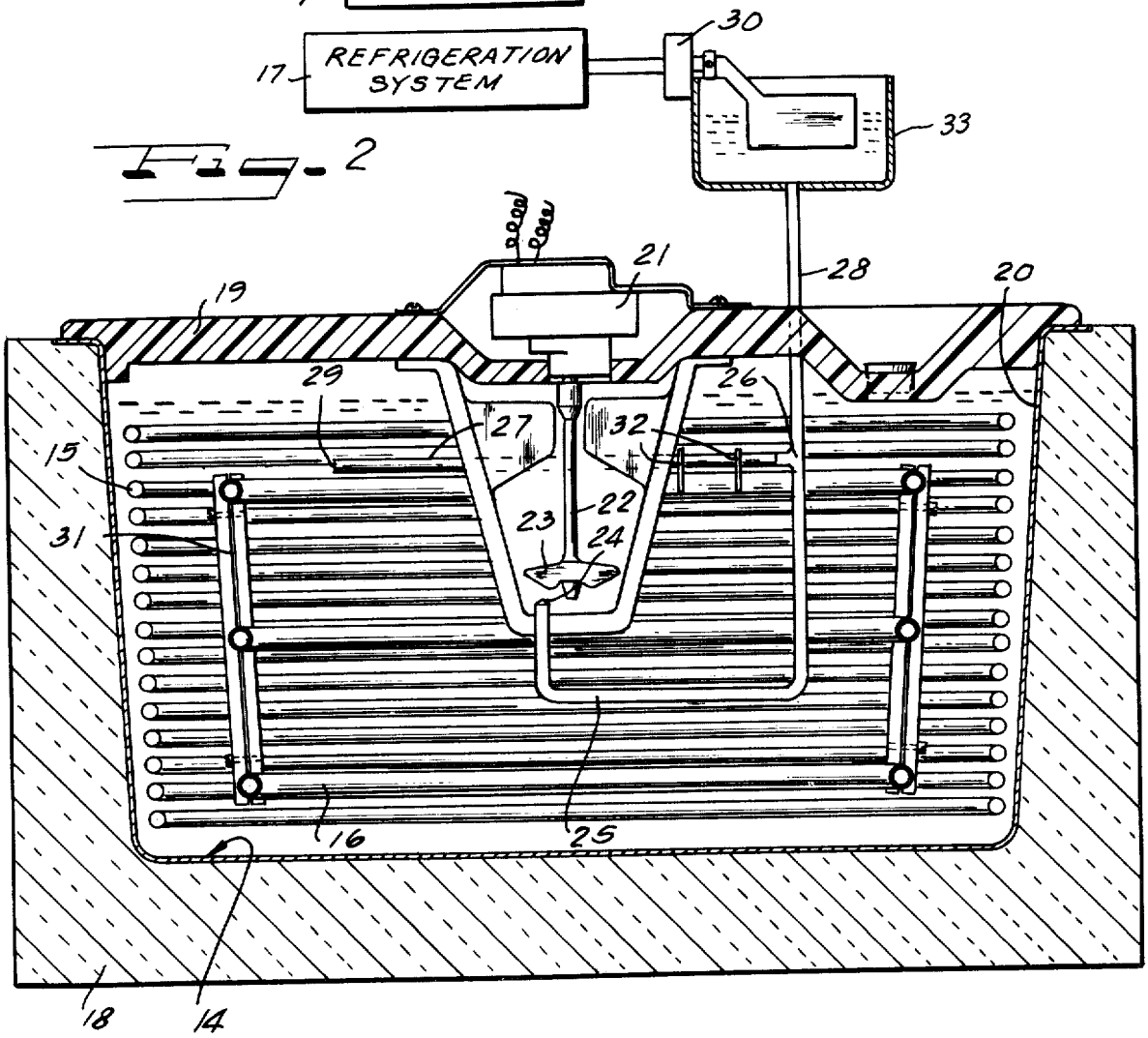
FIG. 2 is an enlarged cross-sectional view, diagrammatic in nature, of the beverage cooling bath of FIG. 1.

As best seen in FIG. 2, the water tank 14 is enclosed by thermal insulation 18, there being a cover 19. The tank 14 is normally nearly filled with water which can be initially poured in in any convenient manner.

The evaporator 16 is spaced well away from the interior wall 20 of the tank 14, and the beverage cooling coil 15 is disposed between the evaporator 16 and the inside wall 20. For reasons of economy of size, the beverage cooling coil 15 can be disposed fairly close to the interior wall 20, but it should be well spaced from the evaporator 16.

When the refrigeration system 17 is energized, heat is removed from the water by the evaporator 16 until the water temperature reaches its freezing point. Thereafter, after removal of the latent heat of fusion, ice begins to form on the outside of the evaporator or evaporator coil 16. The ice formed on the evaporator 16 is known in the trade as an "ice bank". When beverage is not being dispensed from the valve 13, the beverage cooling coil 15, which connects the source 11 to the valve 13, contains beverage which is not flowing, and therefore its temperature will drop along with the temperature of the water in the tank 14. When beverage has been dispensed, the beverage cooling coil 15 becomes partially or fully filled with room-temperature beverage from the source 11, and this warmer beverage, tending to raise the temperature of the water, first acts to melt a portion of the ice forming the ice bank. Thus the effective size of the dispensing system is in part increased by the amount of ice available for such melting. In any given commercial device operating on this principle, the sizes and capacities are so chosen as to meet the desired capacity for serving successive cold servings of beverage. However, when drinks are not being dispensed, the ice bank builds up in size, for example overnight. In order to ensure that the ice bank does not become so large as to engage and possibly freeze the beverage in the beverage cooling coil 15, it is therefore desirable to have means for controling the size of such ice bank, or more specifically, for limiting the maximum size thereof.

According to the principles of the present invention, the beverage cooler bath 10 further includes a motor 21 supported on the cover 19, and in turn supporting a shaft 22, on the lower end of which is an impeller 23. The impeller 23 is analogous to an airplane propeller or the screw of a boat, and on rotation in the proper direction, it causes a current of water to flow in a downward direction. The impeller 23 also functions as an agitator to keep the water in the tank at a fairly uniform temperature, but yet it is so small that it does not apply any significant heat to the water because of its movement. Situated immediately below the impeller 23 is the inlet end 24 of a tube 25 into which water is downwardly forced by the impeller 23. The tube 25 is fixedly supported with respect to the evaporator coil 16, and for the most part comprises plastic material. However, at a point 26 there is a division so that the tube has a first and a second portion or two branches, one branch or portion 27 being three to eight inches long and preferably comprising copper, and the other portion or branch 28 leading in an upward direction for five to twelve inches.

Figure 3:
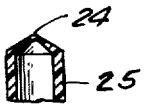
FIG. 3 is a further enlarged detail of a portion of FIG. 2.

The inlet end 24 of the tube 25 is of restricted size and typically is constructed as a nozzle but used in reverse of one, such as diagrammatically shown in FIG. 3. A typical restricted hole size would be on the order of 0.025 inch inside diameter. This restriction functions much like a 1-hole screen so as to keep out foreign particles, and if any becomes lodged thereon, the current from the impeller 23 would wash the same away.

The portion 27 of the tube terminates in an outlet so that water flowing in the portion 27 and discharging therefrom will be directed along, namely parallel to the freezing surface on the evaporator 16. The copper portion 27 of the tube also extends along the length of the evaporator, and in this embodiment, extends parallel thereto. The connection 26 is well spaced from the outlet 29 and is preferably disposed outside of the region that the ice bank occupies so that the tube 25 is always open from the inlet 24, through the connection 26 into the second portion 28. Water is circulated by the impeller 23 and the normal flow is continually through the portion 27 out through the outlet 29. However, because of its proximity to the evaporator 16, and because it can even get surrounded by ice, the water within it begins to coat its interior surface and ultimately to freeze up. When it does so, water or water pressure will be applied to the tube portion 28 which communicates with a reservoir 33 in which there is a control or deenergizing means 30, the same being here formed as a float switch connected to electrically control the refrigeration system 17. If desired such deenergizing means can constitute a pressure switch with a similar connection. Water will not overflow the reservoir 33 because the head pressure in a reverse direction is such that it will not be overcome by the impeller 23.

The coils of the evaporator 16 are spaced apart by a number of spacers 31 and the metal portion 27 of the tube 25 is secured by a number of clips 32 to one of the turns of the coil. The amount of ice that will form can be controlled by the length of the metal portion 27, the length of the clips 32, the force needed to actuate the deenergizing means 30, and the like. Preferably, the means 30 will become actuated shortly before the flow passage through the tube portion 27 is fully blocked, but when there is substantial restriction therein. On melting of ice from the ice bank, ice within the tube 27 will also melt to effect energizing of the refrigeration system.

Although various minor modifications might be suggested by those versed in the art, it should be understood that we wish to embody within the scope of the patent warranted hereon, all such embodiments as reasonably and properly come within the scope of our contribution to the art.

We claim as our invention:

1. A beverage cooling bath adapted to be cooled by a refrigeration system, comprising:
   (a) a thermally insulated water tank;
   (b) an evaporator adapted to be a part of the refrigeration system and supported to be in heat-transfer relation to water in said tank for freezing ice thereon;
   (c) a motor driven water impeller supported in said tank;
   (d) a tube having an inlet end supported in confronting relation to said impeller for receiving a flow of water therefrom, and having an outlet directed along the freezing surface of said evaporator, said tube having a branch connected thereto in spaced relation to said outlet; and
   (e) means connected to said branch and responsive to blockage of flow through said outlet due to the formation of ice between said branch and said outlet, and adapted to be connected to deenergize the refrigeration system.

2. A beverage cooling bath according to claim 1, said evaporator being a separate coil within said tank to which said tube is affixed.

3. A beverage cooling bath according to claim 1, said inlet end of said tube being restricted in size.

4. A beverage cooling bath according to claim 3, the size of said inlet being about 0.025 inch in diameter.

5. A beverage cooling bath according to claim 1, said outlet being in a metal portion of said tube extending in parallel to the adjacent portion of said evaporator.

6. A beverage cooling bath according to claim 1, said tube having a portion downstream of the connection to said branch and which extends along and adjacent to a portion of said evaporator for enabling ice to form within and to thereby block said tube portion.

7. A beverage cooling bath according to claim 1, said branch extending upwardly 5 to 12 inches, said responsive means being a float switch.

8. A beverage cooling bath according to claim 5, said metal portion being three to eight inches long.

9. A beverage cooling bath according to claim 1 in which said impeller is directed to force the water flow downwardly within water in said tank into said tube inlet, the tube inlet being disposed therebeneath and opening upwardly.

10. A beverage cooling bath according to claim 1, said evaporator and said tube being disposed in spaced relation to the interior wall of said tank, and a beverage cooling coil disposed between said interior wall and said evaporator.

11. A beverage cooling bath according to claim 10, said beverage cooling coil being more distant from said evaporator than from said interior wall to enable a substantial build-up of ice between said evaporator and said cooling coil without engulfing said cooling coil with ice.

12. A beverage cooling bath adapted to be cooled by a refrigeration system, comprising:
   (a) a thermally insulated water tank;
   (b) an evaporator adapted to be a part of the refrigeration system and supported to be in heat-transfer relation to water in said tank for freezing ice thereon;
   (c) a motor-driven water impeller supported in said tank;
   (d) a tube having (1) an inlet end supported in confronting relation to said impeller for receiving a flow of water therefrom, and (2) a first and second portion of said tube connected to have water from said inlet delivered thereto, said first portion being directed along the freezing surface of said evaporator and said second portion leading to a reservoir in which a level of water can be maintained in relation to the amount of ice formed in said first portion; and
   (e) means responsive to the level of water in said reservoir and adapted to be connected to control the refrigeration system.

13. A beverage cooling bath according to claim 12, said evaporator being a separate coil within said tank to which said tube is affixed.

14. A beverage cooling bath according to claim 12, said first portion being metal and extending in parallel to the adjacent portion of said evaporator.

15. A beverage cooling bath according to claim 12, said level-responsive means being a float switch.

16. A beverage cooling bath according to claim 12, in which said impeller is directed to force the water flow downwardly within water in said tank into said tube inlet, the tube inlet being disposed therebeneath and opening upwardly.

17. A beverage cooling bath according to claim 12, said evaporator and said tube being disposed in spaced relation to the interior wall of said tank, and a beverage cooling coil disposed between said interior wall and said evaporator.

18. A beverage cooling bath according to claim 12, said beverage cooling coil being more distant from said evaporator than from said interior wall to enable a substantial build-up of ice between said evaporator and said cooling coil without engulfing said cooling coil with ice.

* * * * *